US005569049A

United States Patent [19]

Tatebe et al.

[11] Patent Number: 5,569,049

[45] Date of Patent: Oct. 29, 1996

[54] COAXIAL CONNECTOR PLUG HAVING SHEATH PENETRATING CONTACTS AND RECEPTACLE FOR RECEIVING THE SAME

[75] Inventors: Yu Tatebe; Shuuitsu Sannohe, both of Tokyo, Japan

[73] Assignee: Japan Aviation Electronics Industry, Limited, Japan

[21] Appl. No.: 330,721

[22] Filed: Oct. 5, 1994

[30] Foreign Application Priority Data

Oct. 6, 1993 [JP] Japan ..... 5-250572

[51] Int. Cl.[6] ..... H01R 17/04

[52] U.S. Cl. ..... 439/394; 439/581; 439/582; 439/585; 439/854

[58] Field of Search ..... 439/578–582, 439/394, 854, 859

[56] References Cited

U.S. PATENT DOCUMENTS

| | | | |
|---|---|---|---|
| 3,510,827 | 11/1967 | Spangler | 439/394 |
| 4,326,769 | 4/1982 | Dorsey et al. | 439/21 |
| 4,701,137 | 10/1987 | DeRoss | 439/394 |
| 4,708,414 | 11/1987 | Lam | 439/394 |
| 5,180,315 | 1/1993 | Nagashima | 439/581 |
| 5,263,877 | 11/1993 | Mitani | 439/582 |
| 5,322,453 | 6/1994 | Resnick et al. | 439/581 |

FOREIGN PATENT DOCUMENTS

| | | | |
|---|---|---|---|
| 0519812 | 12/1992 | European Pat. Off. | 439/578 |
| 5-152037 | 6/1993 | Japan | 439/582 |
| 5-234628 | 9/1993 | Japan | 439/578 |
| 5-242931 | 9/1993 | Japan | 439/578 |

*Primary Examiner*—P. Austin Bradley
*Assistant Examiner*—Jill DeMello
*Attorney, Agent, or Firm*—Laff, Whitesel, Conte & Saret, Ltd.

[57] ABSTRACT

In a coaxial connector which comprises a coaxial connector receptacle (93) having a receptacle outer contact (169), and a coaxial connector plug (95) having a plug outer contact (101) with a first contact portion (107) brought into contact with a receptacle outer contact and a second contact portion (111) brought into contact with an outer conductor (155) of a coaxial cable (99), the first contact portion and the second contact portion of the coaxial connector plug are integrally coupled through a coupling portion (113). The second contact portion has a plurality of press-bonding pieces (123, 127) which penetrate a sheath (153) of the coaxial cable to be brought into contact with the outer conductor of the coaxial cable. The press-bonding pieces are arranged so as to surround the coaxial cable. Preferably, the coaxial connector plug has a plug inner contact (105) which has a press-contact portion (145) to be press-contacted with an inner conductor (159) of the coaxial cable.

14 Claims, 17 Drawing Sheets

PRIOR ART

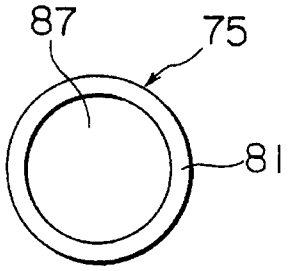
PRIOR ART
FIG. 10A
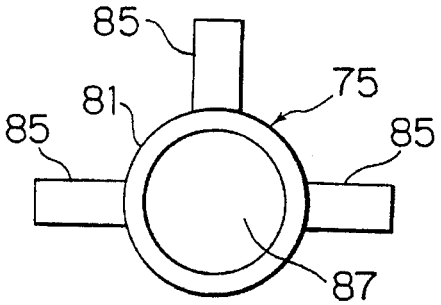
PRIOR ART
FIG. 10C
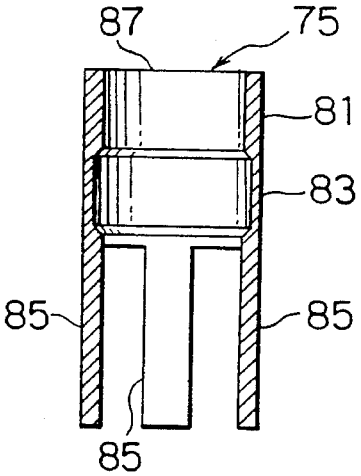
PRIOR ART
FIG. 10B
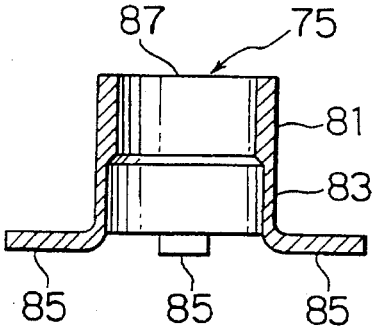
PRIOR ART
FIG. 10D
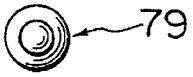
PRIOR ART
FIG. 12A
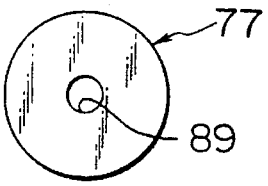
PRIOR ART
FIG. 11A
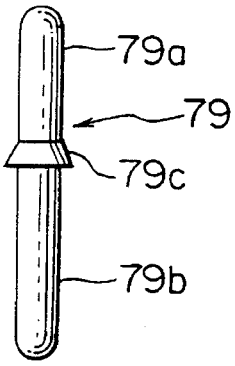
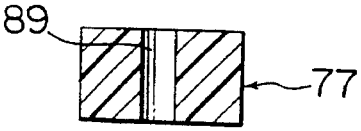
PRIOR ART
FIG. 11B
PRIOR ART
FIG. 12B

COAXIAL CONNECTOR PLUG HAVING SHEATH PENETRATING CONTACTS AND RECEPTACLE FOR RECEIVING THE SAME

BACKGROUND OF THE INVENTION

The present invention relates to a coaxial connector which is for use in an electrical connection between a printed circuit board and a coaxial cable in various kinds of apparatus and, in particular, to a coaxial connector comprising a coaxial connector plug and a coaxial connector receptacle.

Generally, the coaxial cable comprises from the inside in a sequential order an inner conductor, an insulator, an outer conductor, and a sheath generally concentrically.

The coaxial connector plug comprises an outer contact, a clamp ring, an inner contact, and an insulator. The outer contact is connected to the outer conductor of the coaxial cable. The clamp ring is deformed and thereby fixes the outer contact to the coaxial cable. The inner contact is electrically connected to the inner conductor of the coaxial cable by soldering or the like. The insulator insulates the inner contact from the outer contact.

In a conventional coaxial connector plug of the type mentioned above, the outer contact and the clamp ring are prepared as separate parts, respectively. Accordingly, this increases the number of parts and results in an increase of production cost.

Additionally, in the conventional coaxial connector plug, a skilled workman is required to connect, by soldering, the inner contact to the inner conductor of the coaxial cable. Further, there is a risk that peripheral parts of the inner contact suffer a damage or scorching due to heat generated in the soldering operation.

Furthermore, one end portion of the coaxial cable is processed into a stepped form so that the inner conductor and the outer conductor are exposed at different axial positions, in order to be connected to the inner contact and the outer contact of the coaxial connector plug, respectively. Such a processing treatment to the end portion of the coaxial cable is troublesome.

Description will now be made as regards the coaxial connector receptacle. The coaxial connector receptacle comprises an outer contact, an insulator, and a central contact. The outer contact is electrically fittedly connected to the outer contact of the coaxial connector plug. The insulator is received in the outer contact. The central contact is press-fit into and through the central part of the insulator to be fixed.

In the conventional connector receptacle, the central contact is press-fittedly fixed to the insulator. In such a case, it is a disadvantage that a production cost is increased because further equipment and production step for press-fitting are required.

SUMMARY OF THE INVENTION

It is a general object of this invention to provide a coaxial connector which is small in size, relatively easy in assemblage, and low in the production cost.

It is a particular object of this invention to provide a coaxial connector plug which is reduced in the number of parts and easy in connection operation with a coaxial cable.

It is another object of this invention to provide a coaxial connector plug wherein soldering the coaxial cable to an inner contact is eliminated so as to prevent peripheral parts from a damage or the like due to heat.

It is another specific object of this invention to provide a coaxial connector receptacle which is low in the cost by eliminating press-fitting of the central contact into the insulator.

According to an aspect of this invention, there is provided a coaxial connector plug comprising an outer contact having a first contact portion brought into contact with an outer contact of an coaxial connector receptacle and a second contact portion brought into contact with an outer conductor of an coaxial cable. In the coaxial connector plug with the aspect mentioned above, the first contact portion and the second contact portion are integrally coupled by way of a coupling portion. The second contact portion has a plurality of press-bonding pieces for penetrating a sheath of the coaxial cable to come into contact with the outer conductor of the coaxial cable. The press-bonding pieces are arranged so as to surround the coaxial cable. Preferably, the coaxial connector plug comprises an inner contact having press-contact pieces to be Press-contacted to an inner conductor of the coaxial cable.

According to another aspect of this invention, there is provided a coaxial connector receptacle which is mounted on a printed circuit board and which comprises a receptacle outer contact, a receptacle inner contact, and a receptacle insulator holding both of the receptacle outer and inner contacts. In the receptacle with the above-mentioned aspect, the receptacle outer contact has a first conducting portion at one end. The receptacle inner contact has one end portion surrounded by the receptacle outer contact and has a conducting portion being exposed on one surface of the receptacle insulator. The receptacle insulator has a receiving portion for receiving the first conducting portion.

According to still another aspect of this invention, there is provided a coaxial connector comprising a coaxial connector receptacle having a receptacle outer contact and a coaxial connector plug having a plug outer contact having a first contact portion brought into contact with the receptacle outer contact and a second contact portion brought into contact with an outer conductor of the coaxial cable. In the coaxial connector with the above-mentioned aspect, the first contact portion and the second contact portion of the coaxial connector plug are integrally coupled by way of a coupling portion. On the other hand, the second contact portion comprises a plurality of press-bonding pieces for penetrating the sheath of the coaxial cable to come into contact with the outer conductor of the coaxial cable. The press-bonding pieces are arranged so as to surround the coaxial cable.

Preferably, in the present invention, the coaxial connector plug comprises an inner contact having a contact piece to be press-contacted to the inner conductor of the coaxial cable.

BRIEF DESCRIPTION OF THE DRAWINGS

FIG. 10A is a plan view showing a receptacle outer contact of the conventional coaxial connector receptacle;

FIG. 10B is a front sectional view of the receptacle outer contact of FIG. 10A;

FIG. 10C is a plan view showing the receptacle outer contact of FIG. 10A but after a terminal fixing portion is worked;

FIG. 10D is a front sectional view of the worked receptacle outer contact of FIG. 10C;

FIG. 11A is a plan view showing a receptacle insulator of the conventional coaxial connector receptacle;

FIG. 11B is a front sectional view of the receptacle insulator of FIG. 11A;

FIG. 12A is a plan view showing a central contact of the conventional connector receptacle;

FIG. 12B is a front view of the central contact of FIG. A;

DESCRIPTION OF THE PREFERRED EMBODIMENTS

Before description is made as regards a preferred embodiment, a conventional connector is described with reference to FIGS. 1 to 12 to understand the invention more easily.

Figure 1A:
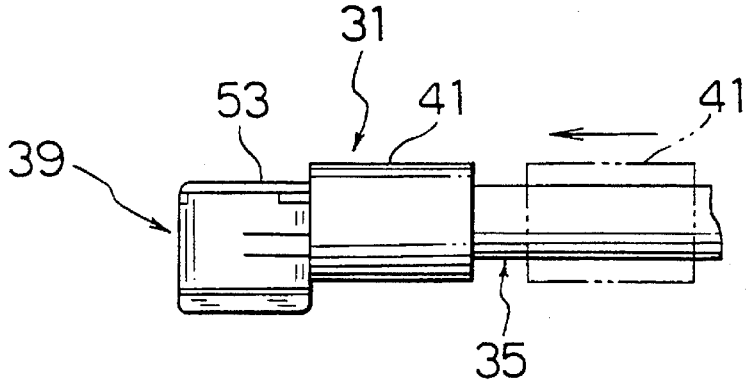
PRIOR ART FIG. 1A
FIG. 1A is a front view showing a conventional coaxial connector plug.

As shown in FIG. 1A, the conventional coaxial connector comprises a coaxial connector plug 31 and a coaxial connector receptacle 33 (see FIG. 9A) which can be mated and electrically connected with each other.

Figure 1B:
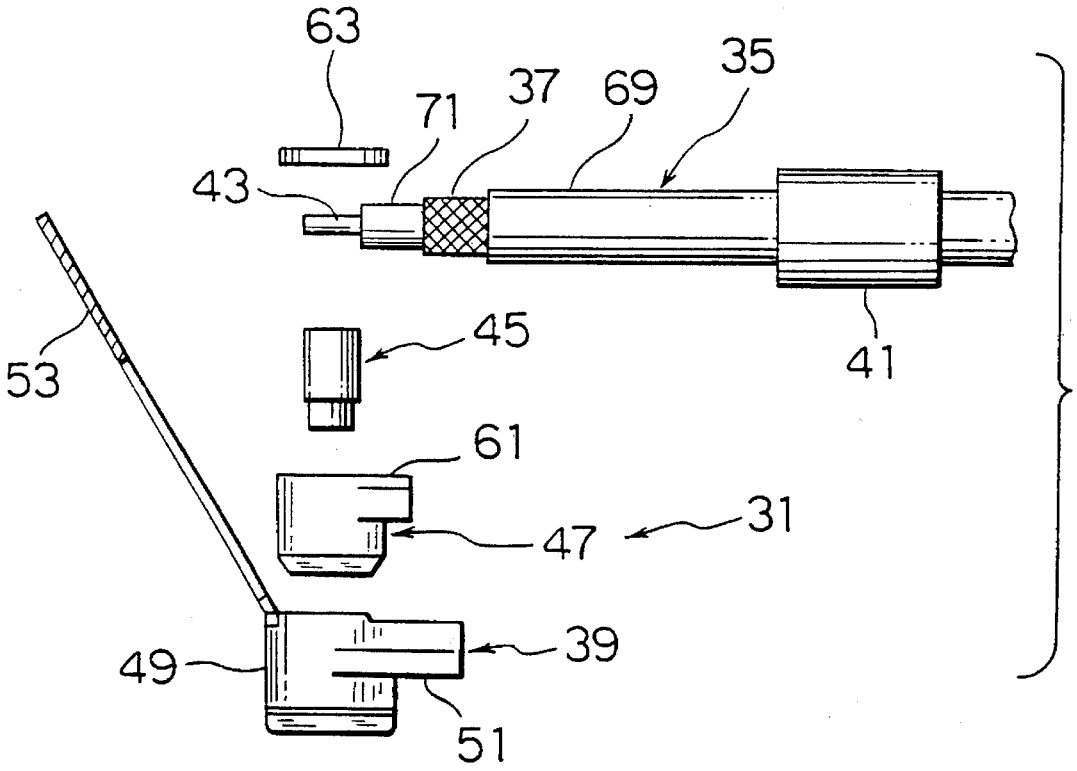
PRIOR ART FIG. 1B
FIG. 1B is a view showing a disassembled coaxial connector plug of FIG. 1A and a connection thereof with a coaxial cable.

As shown in FIGS. 1A and 1B, the coaxial connector plug 31 comprises a plug outer contact 39 connected to an outer conductor 37 of a coaxial cable 35, a clamp ring 41 for clamping the plug outer contact 39 to the coaxial cable 35, a plug inner contact 45 electrically connected to an inner conductor 43 of the coaxial cable 35, and an insulator 47 for insulating the plug inner contact 45 from the plug outer contact 39.

Figure 2A:
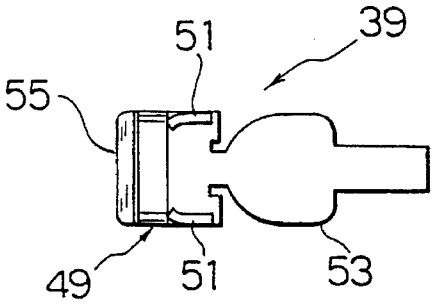
PRIOR ART FIG. 2A
FIG. 2A is a plan view showing a plug outer contact of the conventional coaxial connector plug.
Figure 2B:
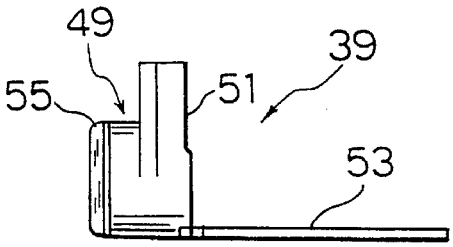
PRIOR ART FIG. 2B
FIG. 2B is a front view of the plug outer contact of FIG. 2A.
Figure 2C:
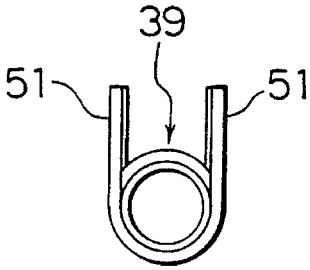
PRIOR ART FIG. 2C
FIG. 2C is a right side view of the plug outer contact of FIG. 2A.

With reference to FIGS. 2A, 2B, and 2C, the plug outer contact 39 comprises a generally cylindrical outer shell portion 49, an outer contact cable guide portion 51 extending from the outer shell portion 49 in a perpendicular direction, and a cover portion 53 extending from a part of the outer shell portion 49 in its axial direction. The outer peripheral surface of the outer shell portion 49 forms a first contact portion 55 brought into contact with the coaxial connector receptacle 33, and the cable guide portion 51 forms a second contact portion brought into contact with the outer conductor 37 of the coaxial cable 35.

Figure 3A:
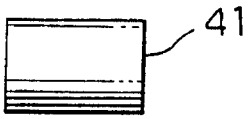
PRIOR ART FIG. 3A
FIG. 3A is a front view showing a clamp ring in the conventional coaxial connector plug.
Figure 3B:
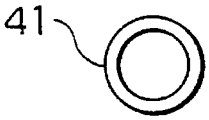
PRIOR ART FIG. 3B
FIG. 3B is a right side view of the clamp ring of FIG. 3A.

The clamp ring 41 is, as shown in FIGS. 3A and 3B, formed in a cylindrical shape so that the coaxial cable 35 can be inserted thereinto.

Figure 4A:
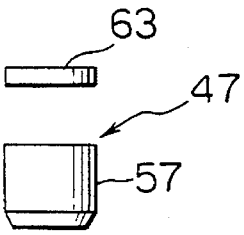
PRIOR ART FIG. 4A
FIG. 4A is a left side view showing a plug insulator in a conventional coaxial connector.
Figure 4B:
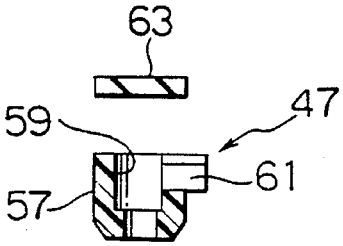
PRIOR ART FIG. 4B
FIG. 4B is a front sectional view of the plug insulator of FIG. 4A.
Figure 4C:
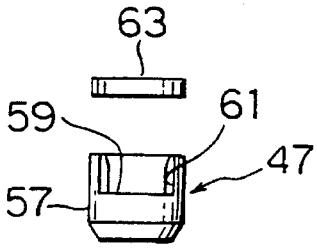
PRIOR ART FIG. 4C
FIG. 4C is a right side view of the plug insulator of FIG. 4A.

As illustrated in FIGS. 4A, 4B, and 4C, the plug insulator 47 has a cylindrical body 57 capable of being received within the outer shell portion 49 of the plug outer contact 39. The body 57 has an inner contact insertion hole 59 capable of receiving the plug inner contact 45. An insulator cable guide portion 61 extends from the body 57 in a perpendicular direction. The body 57 is provided with a cover 63 for closing an upper opening thereof.

Figure 5A:
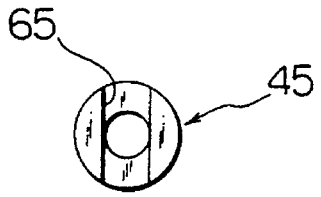
PRIOR ART FIG. 5A
FIG. 5A is a plan view showing a plug inner contact in the conventional coaxial connector plug.
Figure 5B:
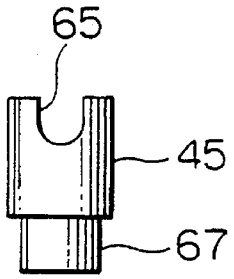
PRIOR ART FIG. 5B
FIG. 5B is a front view of the plug inner contact of FIG. 5A.
Figure 5C:
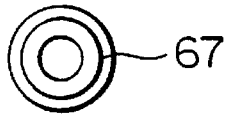
PRIOR ART FIG. 5C
FIG. 5C is a bottom view of the plug inner contact of FIG. 5A.

Referring to FIGS. 5A, 5B, and 5C, the plug inner contact 45 has a shape capable of being inserted in the inner contact insertion hole 59. At the upper portion of the plug inner contact 45, an inner conductor contact portion 65 is formed for being brought into contact with the inner conductor 43 (see FIGS. 1 and 6) of the coaxial cable 35. On the other hand, at the lower portion of the plug inner contact 45, an inner contact portion 67 having a smaller diameter is formed so as to be brought into contact with the receptacle inner contact of the coaxial connector receptacle 33. The inner conductor contact portion 65 has a grooved recess formed in a radial direction so as to be able to receive the inner conductor 43 of the coaxial cable 35.

Figure 6:
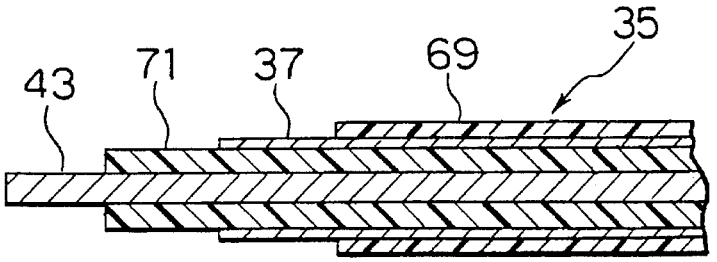
PRIOR ART FIG. 6
FIG. 6 is a sectional view showing a structure of one end portion of the conventional coaxial cable.

As shown in FIG. 6, the coaxial cable 35 comprises a sheath 69, the outer conductor 37, an insulator 71, and the inner conductor 43. An end connecting portion of the coaxial cable 35 is processed so that those are exposed and arranged in a stepped form.

With reference to FIGS. 1A and 1B again, description will now be made as regards assembling processes of the coaxial connector plug 31. The plug insulator 47 is received in the outer shell portion 49 of the plug outer contact 39. Then, the plug inner contact 45 is received within the plug insulator 47. The coaxial cable 35 is disposed so that the inner conductor 43 is put on the plug inner contact 45, the insulator 71 is put on the cable guide portion 61 of the plug insulator 47, and the outer conductor 37 is put on the cable guide portion 51 of the plug outer contact 39. Thereafter, the inner conductor 43 is covered with the cover 63 thereupon. Next, a cover portion 53 of the outer contact 39 is bent over and located on the cover 63 and the clamp ring 41 is moved in an axial direction and is deformed to clamp the cable 35.

Figures 7A, 7B, 7C:
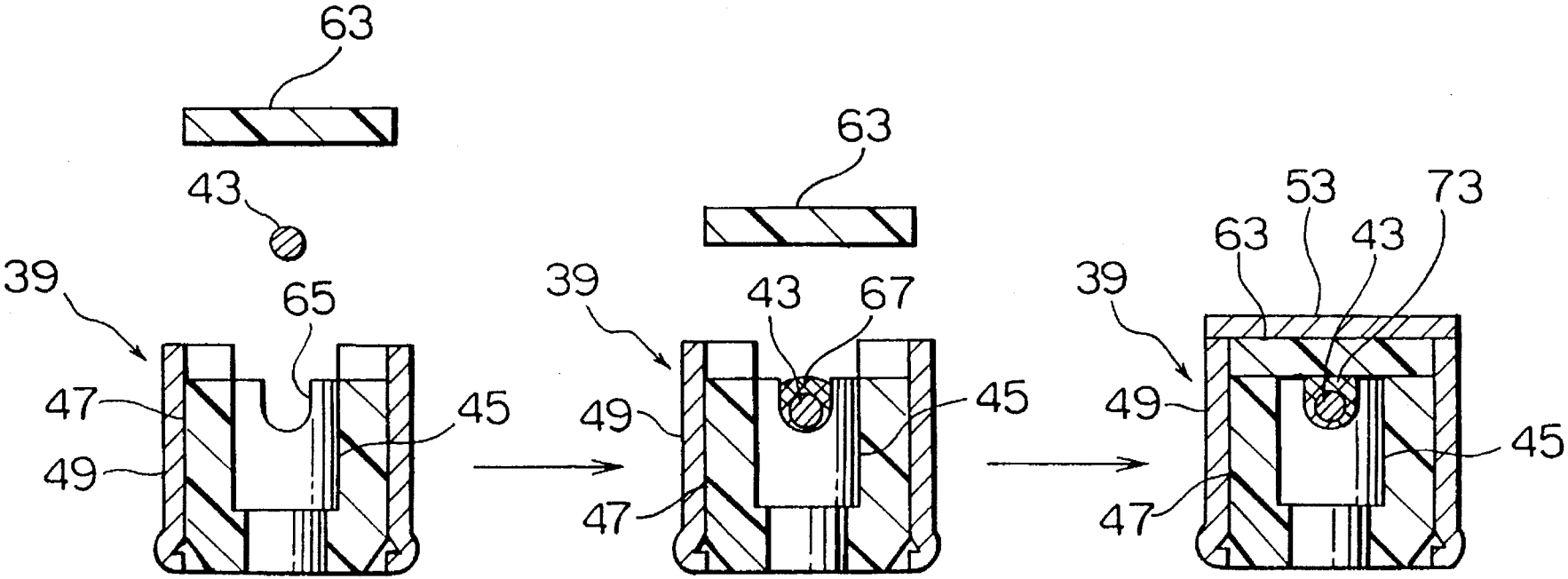
FIG. 7A PRIOR ART
FIG. 7B PRIOR ART
FIG. 7A is a sectional view showing a state of the conventional coaxial connector before an inner conductor of the coaxial cable is connected to the inner contact of the coaxial connector plug.
FIG. 7B is a sectional view showing a state after the inner conductor being fixed to the inner contact by soldering.
FIG. 7C is a sectional view showing a completed state of the plug after covers are attached to the state of FIG. 7B.

As shown in FIGS. 7A, 7B, and 7C, after the inner conductor 43 of the coaxial cable 35 is put on the inner conductor contact portion 65 of the inner contact 45, electrical and mechanical connection of them is carried out by solder 73. Thereafter, electrical insulation from the plug outer contact 39 is done by covering with the inner cover 63. Additionally, the outer cover portion 53 is mounted thereon.

Figure 8A:
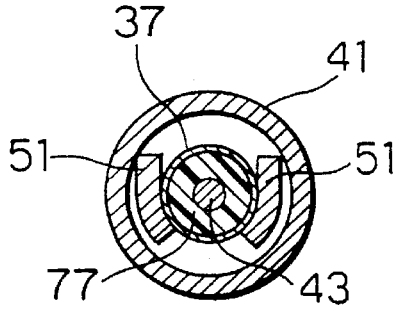
PRIOR ART FIG. 8A
FIG. 8A is a sectional view of the conventional coaxial connector showing a state before a clamp ring is deformed.
Figure 8B:
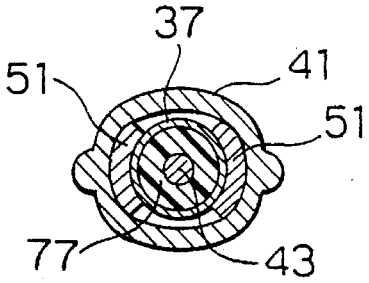
PRIOR ART FIG. 8B
FIG. 8B is a sectional view showing a state after the clamp ring is deformed.

As shown in FIG. 8A, after the clamp ring 41 is moved in the axial direction and located outside the cable guide portion 51 forming a contact portion, deformation is carried out as shown in FIG. 8B. As a result, the cable guide portion 51 and the outer conductor 37 are electrically connected.

Figure 9A:
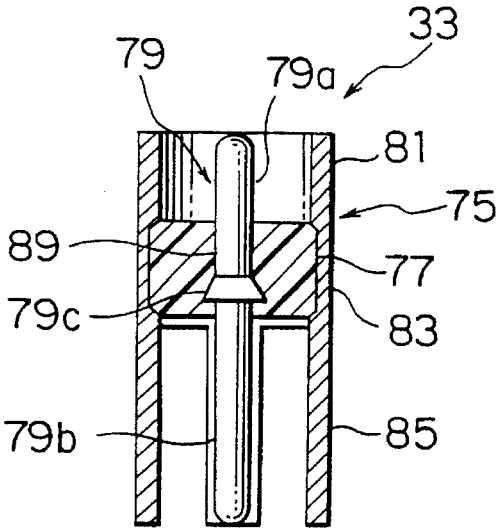
PRIOR ART FIG. 9A
FIG. 9A is a front sectional view showing a conventional coaxial connector receptacle.
Figure 9B:
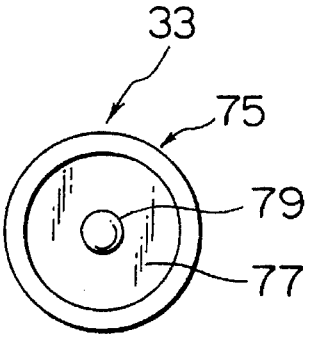
PRIOR ART FIG. 9B
FIG. 9B is a plan view of the coaxial connector receptacle of FIG. 9A.
Figure 13A:
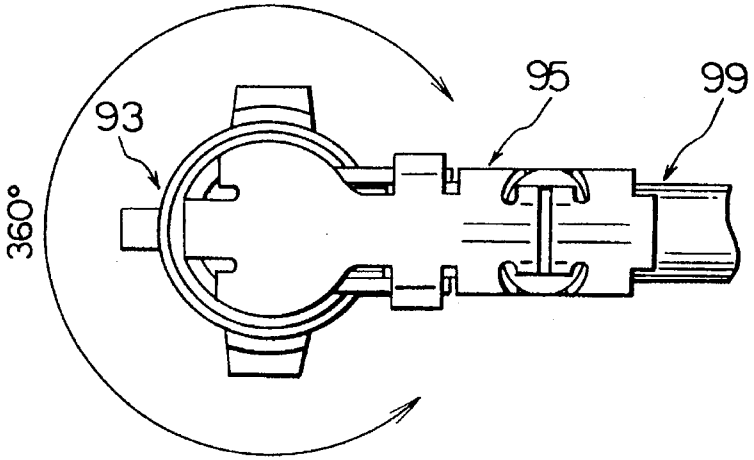
FIG. 13A is a plan view showing the coaxial connector according to an embodiment of this invention.
Figure 13B:
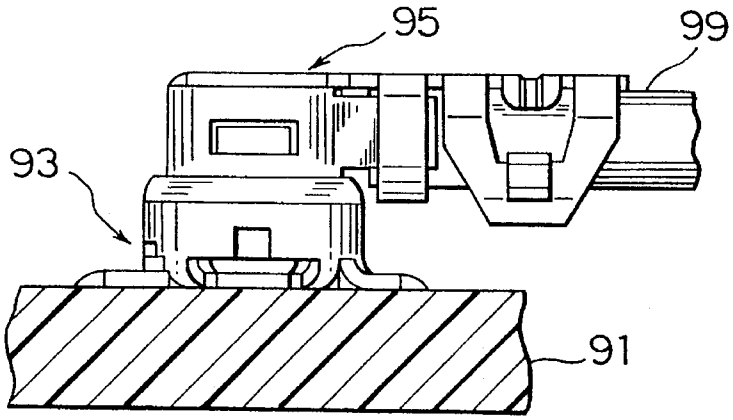
FIG. 13B is a front view of the coaxial connector of FIG. 13A.
Figure 13C:
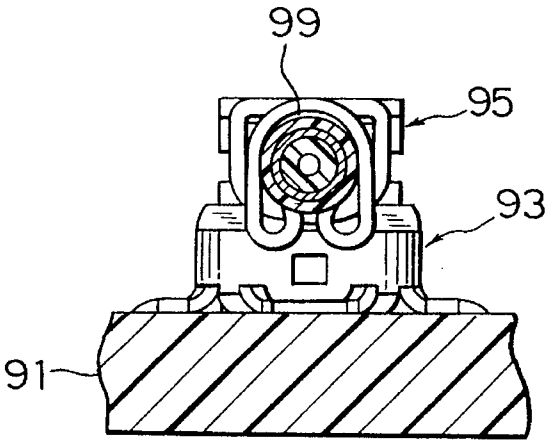
FIG. 13C is a side view of the coaxial connector of FIG. 13A.
Figure 14A:
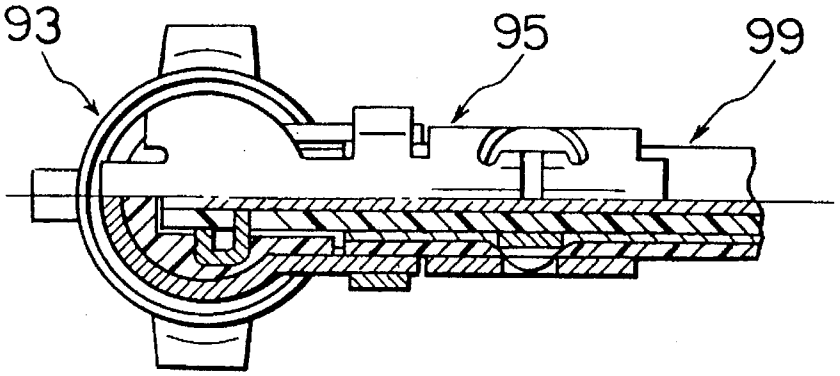
FIG. 14A is a half-sectional plan view of the coaxial connector of FIG. 13A.
Figure 14B:
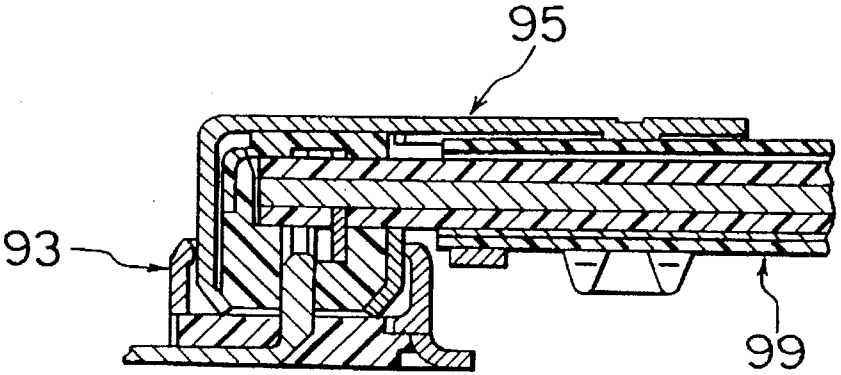
FIG. 14B is a vertical sectional view of the coaxial connector of FIG. 13A.
Figure 14C:
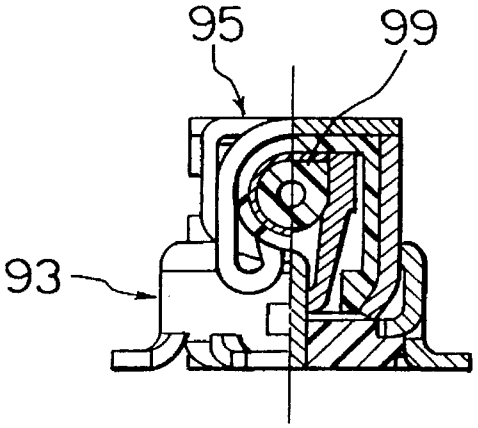
FIG. 14C is a half-sectional side view of the coaxial connector of FIG. 13A.
Figure 15A:
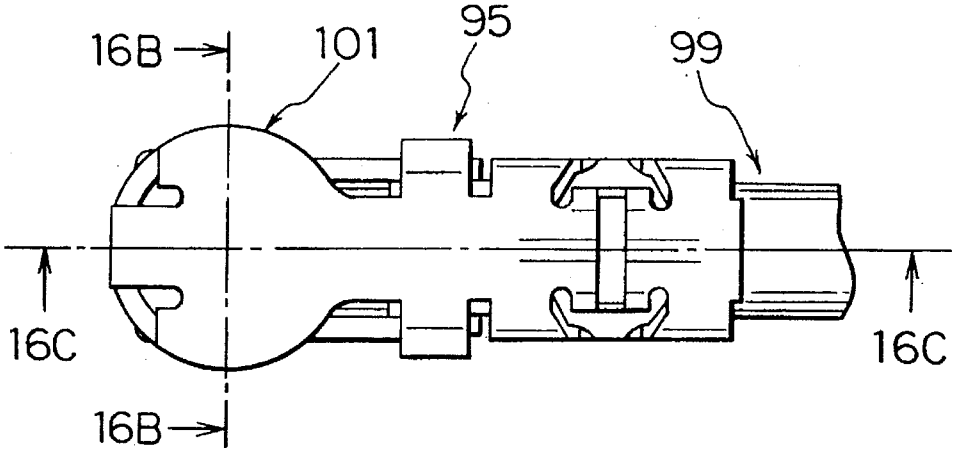
FIG. 15A is a plan view showing a coaxial connector plug according to the embodiment of this invention.
Figure 15C:
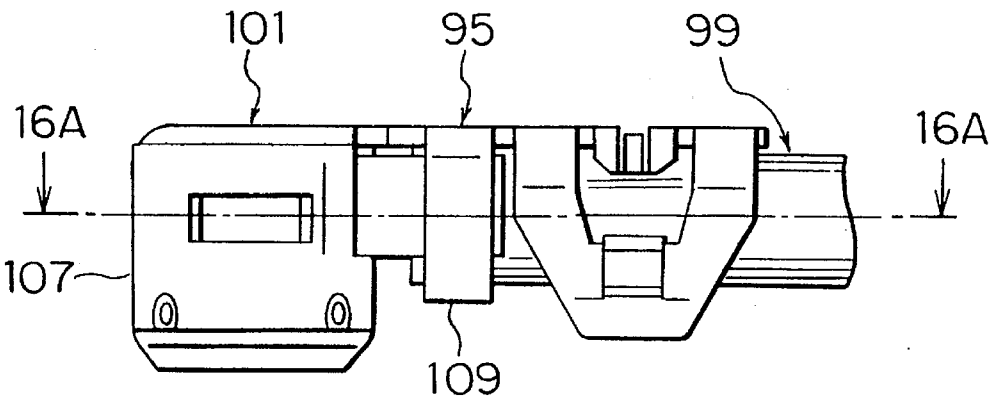
FIG. 15C is a front view of the coaxial connector plug of FIG. 15A.
Figure 15B:
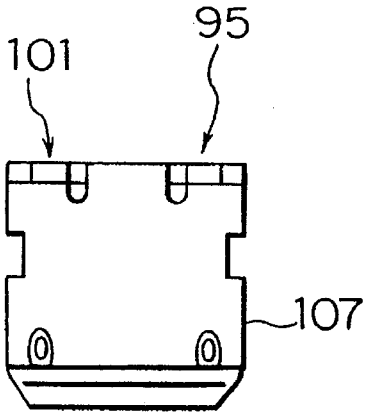
FIG. 15B is a side view of the coaxial connector plug of FIG. 15A.
Figure 16A:
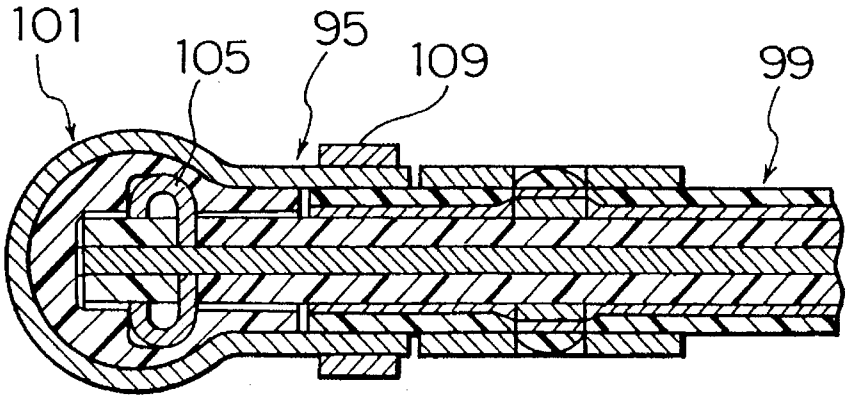
FIG. 16A is a sectional view of the coaxial connector plug taken along a line 16A—16A in FIG. 15C.
Figure 16C:
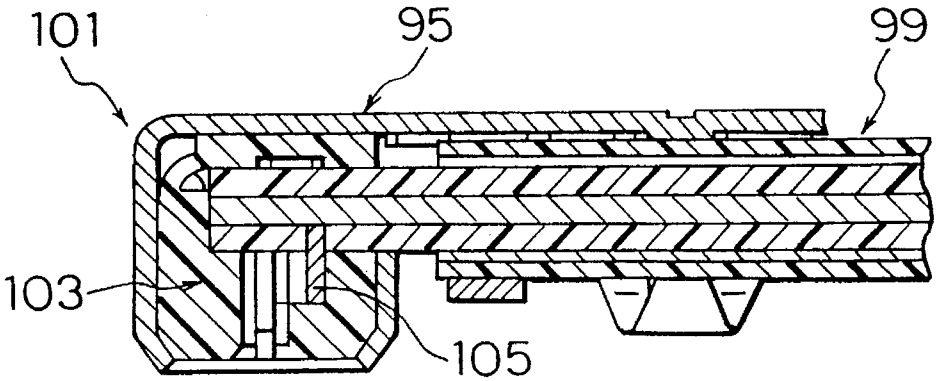
FIG. 16C is a sectional view taken along a line 16C—16C in FIG. 15A.
Figure 16B:
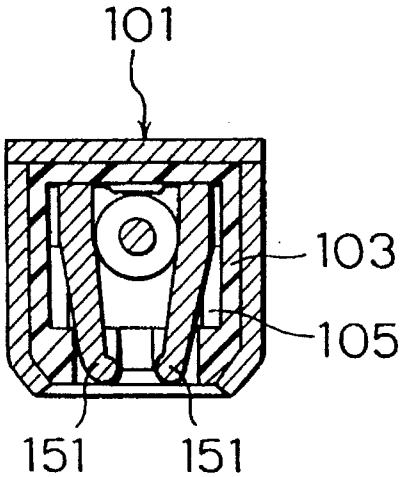
FIG. 16B is a sectional view taken along a line 16B—16B in FIG. 15A.

Next, description is made as regards the conventional coaxial connector receptacle 33 with reference to FIGS. 9 to 12. As shown in FIG. 9, the coaxial connector receptacle 33 comprises a receptacle outer contact 75 fitted and electrically connected to the plug outer contact 39 of the coaxial connector plug 31, a receptacle insulator 77 being received within the receptacle outer contact 75, and a central contact 79 penetrating the central part of the receptacle insulator 77.

As illustrated in FIGS. 10A, 10B, 10C, and 10D, the receptacle outer contact 75 comprises a cylindrical third contact portion 81 fittable to the plug outer contact 39 of the coaxial connector plug 31, a cylindrical insulator holding portion 83 connected to the third contact portion 81, and leg-like terminal fixing portions 85 extending downward from the insulator holding portion 83. At the upper part of the contact portion 81, an opening 87 is formed which is capable of inserting the outer shell portion 49 of the coaxial connector plug 31 therein. When the terminal fixing portions 85 are mounted on a printed circuit board which is not shown in figures, it is perpendicularly bent outwardly.

In FIGS. 11A and 11B, the cylindrical receptacle insulator 77 is provided with a central contact insertion hole 89 in the central part thereof.

As shown in FIGS. 12A and 12B, the central contact 79 is formed in a stick-shape and comprises an inner contact portion 79*a* for use as a fourth contact portion electrically brought into contact with the plug inner contact 45 (see FIGS. 5A, 5B, and 5C) of the coaxial connector plug 31, a terminal fixing portion 79*b* electrically connected to a terminal at a printed circuit board-side, and a fixing tooth 79*c* for fixing the central contact 79 itself to the receptacle insulator 77 (see FIG. 10).

With reference to FIG. 9 again, the receptacle insulator 77 is received in the insulator holding portion 83 of the receptacle outer contact 75. In the central contact insertion hole 89 of the insulator 77, the central contact 79 is inserted. The fixing tooth 79*c* of the central contact 79 is located within the central contact insertion hole 89 so as to prevent the central contact 79 from moving in an axial direction.

In the conventional coaxial connector plug 31, the plug outer contact 39 and the clamp ring 41 for connecting the plug outer contact 39 to the coaxial cable 35 are prepared as separate parts, respectively. Consequently, the number of parts becomes large and production cost is increased. Additionally, in the conventional coaxial connector plug, soldering is made in a connection between the inner conductor 43 of the coaxial cable 35 and the inner contact 45. This requires an expert for the soldering and brings a risk that peripheral parts are subjected to a damage due to heat. Furthermore, it is necessary to expose the inner conductor 43 and the outer conductor 37 of the coaxial cable 35 so as to be connected with the plug inner contact 45 and the plug outer contact 39 of the coaxial connector plug, respectively. This makes a process of the end portion of the coaxial cable 35 complicated.

Additionally, in the conventional coaxial connector receptacle, the central contact 79 is press-fitted and fixed to the receptacle insulator 77. It is therefore necessary to have an equipment and a production-step for the press-fitting operation. This results in a disadvantage that production cost is increased.

Description will now be made as regards a preferred embodiment of this invention with reference to FIGS. 13 to 30.

As shown in FIGS. 13A to 13C and 14A to 14C, a coaxial connector 91 comprises a coaxial connector receptacle (hereinafter called receptacle) 93 and a coaxial connector plug (hereinafter called plug) 95 both of which are fitted and electrically connected each other. The connector receptacle 93 is connected to a printed circuit board 97. A coaxial cable 99 is connected to the plug 95. The plug 95 is, as shown by an arrow in FIG. 13A, arranged so as to be pivotable over 360 angular degrees on the receptacle 93.

With reference to FIGS. 15A to 15C and 16A to 16C, the plug 95 comprises a plug outer contact 101, a plug insulator 103 being received within the plug outer contact 101, and a plug inner contact 105 being received within the plug insulator 103. Numerals 107 and 109 denote an outer shell portion and a band portion, respectively, which will later be described.

Figure 17A:
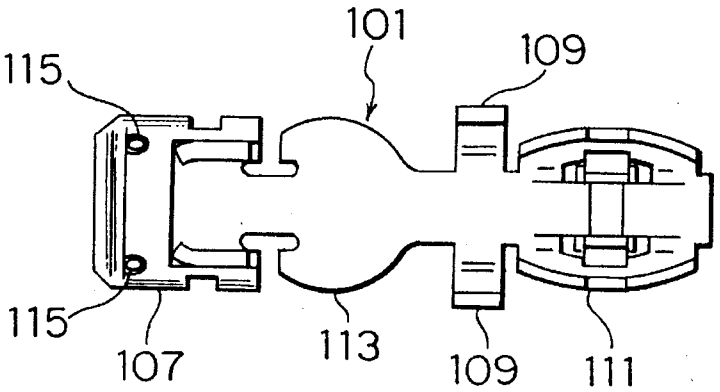
FIG. 17A is a plan view showing a plug outer contact of the coaxial connector plug of FIG. 15A.
Figure 17B:
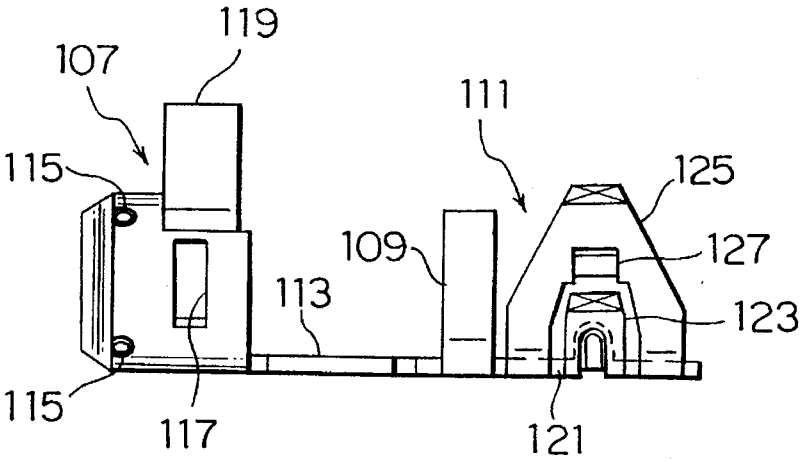
FIG. 17B is a front view of the plug outer contact of FIG. 17A.
Figure 17C:
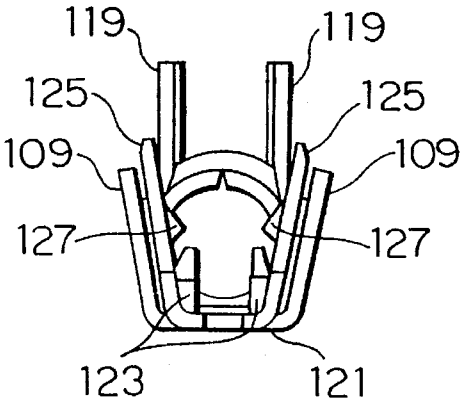
FIG. 17C is a side view of the plug outer contact of FIG. 17A.

With reference to FIGS. 17A, 17B, and 17C, the plug outer contact 101 comprises the outer shell portion 107 capable of being fitted and connected to the receptacle 93 (see FIGS. 13 and 14), a press-bonding portion 111 press-bonded and connected to the coaxial cable 99 (see FIGS. 13 to 16), and an outer cover portion 113 for closing an opening of the outer shell portion 107. The outer shell portion 107 is formed in a generally cylindrical shape and forms a first contact portion. At the outer periphery of a fitting portion of the outer shell portion 107 fitted into the receptacle 93, a plurality of projections, pads, or dowels 115 (for example, three to four points) are formed to ensure an electrical contact with the receptacle 93. The outer shell portion 107 has an outer peripheral wall having an opening 117 for operating an extracting-tool therethrough. In addition, from one end of the outer peripheral wall of the outer shell portion 107, a cable guide portion 119 for guiding the coaxial cable 99 extends perpendicularly in a direction along the central axis of the outer shell portion 107. The outer cover portion 113 serves also as a coupling portion for coupling the outer shell portion 107 with the press-bonding portion 111. The outer cover portion 113 is formed integral with the outer shell portion 107 and the press-bonding portion 111. Between the cover portion 113 and the press-bonding portion 111, a pair of band portions 109 is formed to hold the coaxial cable 99. The press-bonding portion 111 acts as a second contact brought into contact with the outer conductor of the coaxial cable. As understood from FIG. 17C, the press-bonding portion 111 comprises a pair of first press-bonding pieces 123 projecting in a U-shape or a U-shape from a base 121 and a pair of second press-bonding pieces 125 projecting longer than the first press-bonding pieces 123. A projecting end or tip of each of the press-bonding pieces 123 and 125 is formed sharp so as to penetrate a sheath of the coaxial cable 99. The second press-bonding pieces 125 have guide portions 127 for guiding and centering the coaxial cable 99.

Figure 18A:
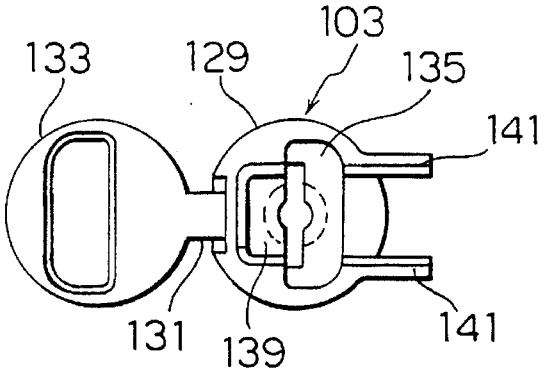
FIG. 18A is a plan view showing a plug insulator of the coaxial connector plug of FIG. 15A.
Figure 18B:
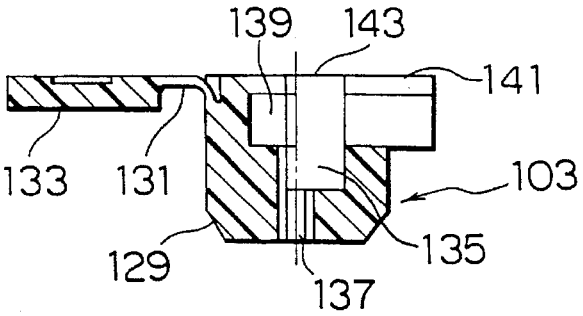
FIG. 18B is a front sectional view of the plug insulator of FIG. 18A.
Figure 18C:
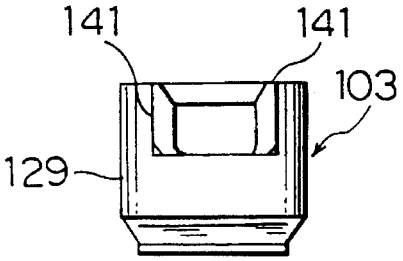
FIG. 18C is a side view of the plug insulator of FIG. 18A.

Referring to FIGS. 18A, 18B, and 18C, the insulator 103 comprises a substantially cylindrical body 129 capable of being received in the outer shell portion 107 of the plug outer contact 101 and an insulating cover 133 connected to the body 129 through a hinge 131. The body 129 comprises an inner contact receiving portion 135 for receiving the plug inner contact 105 (see FIGS. 15 and 16), a guide hole 137 for guiding the contact portion of the inner contact 105, a guide groove 139 for guiding the coaxial cable 99 (see FIGS. 13 to 16), and an inner cable guide portion 141. The inner cable guide portion 141 projects outwardly in a perpendicular direction to the central axis of the body 129. One end of the body 129 has an opening portion 143 which is closed by the insulating cover 133.

Figure 19A:
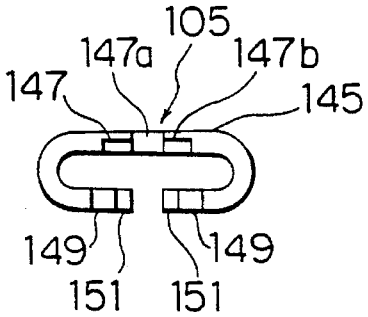
FIG. 19A is a plan view showing a plug inner contact of the coaxial connector plug of FIG. 15A.
Figure 19B:
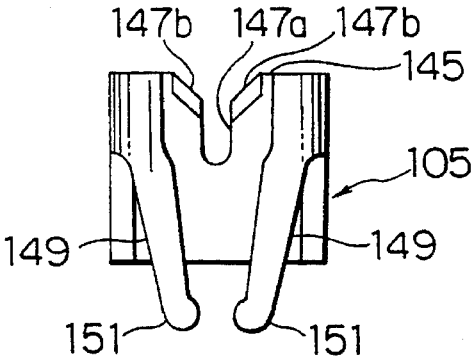
FIG. 19B is a front view of the plug inner contact of FIG. 19A.
Figure 19C:
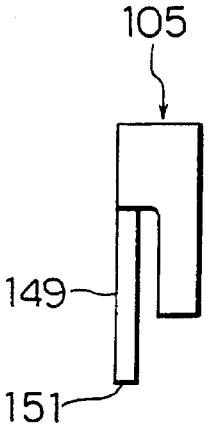
FIG. 19C is a side view of the plug inner contact of FIG. 19A.

In FIGS. 19A, 19B, and 19C, the plug inner contact 105 is formed in a link shape and has a press-contact portion 145. In the central part of the press-contact portion 145, a U-shaped groove 147*a* is formed to be brought into contact with the inner conductor of the coaxial cable 99 (see FIGS. 13 to 16). At both sides of the U-shaped groove 147*a*, a pair of press-contact blades 147*b* is formed to divergently expand upwardly. The press-contact blades 147*b* penetrate the inner insulator of the coaxial cable 99 so that the press-contact portion 145 is electrically connected to the inner conductor of the coaxial cable 99. The plug inner contact 105 has a pair of spring portions 149 extending downward. The lower end of each of spring portions 149 has an inner contact portion 151 brought into contact with the inner contact of the receptacle 93.

Figure 20:
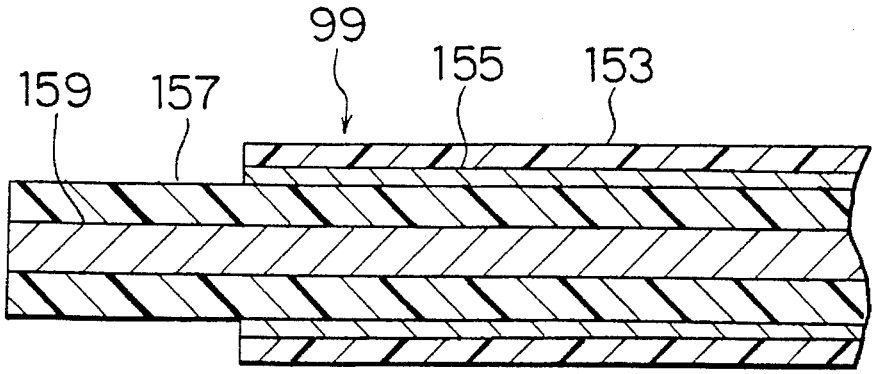
FIG. 20 is a vertical sectional view showing a structure of one end portion of the coaxial cable in the embodiment of this invention.

As illustrated in FIG. 20, the coaxial cable 99 comprises a sheath 153, an outer conductor 155, an inner insulator 157, and an inner conductor 159. The end portion of the coaxial cable 99 is processed different from that of the conventional coaxial cable in that the sheath 153 and the outer conductor 155 are partly removed at one end portion of the coaxial cable 99 so that the inner insulator 157 and the inner conductor 159 are projected with both substantially equal length from the common end of the sheath 153 and the outer conductor 155.

With reference to FIGS. 21 to 28, description will be made as regards an operation of connecting the coaxial cable 99 to the coaxial connector plug 95.

Figure 21:
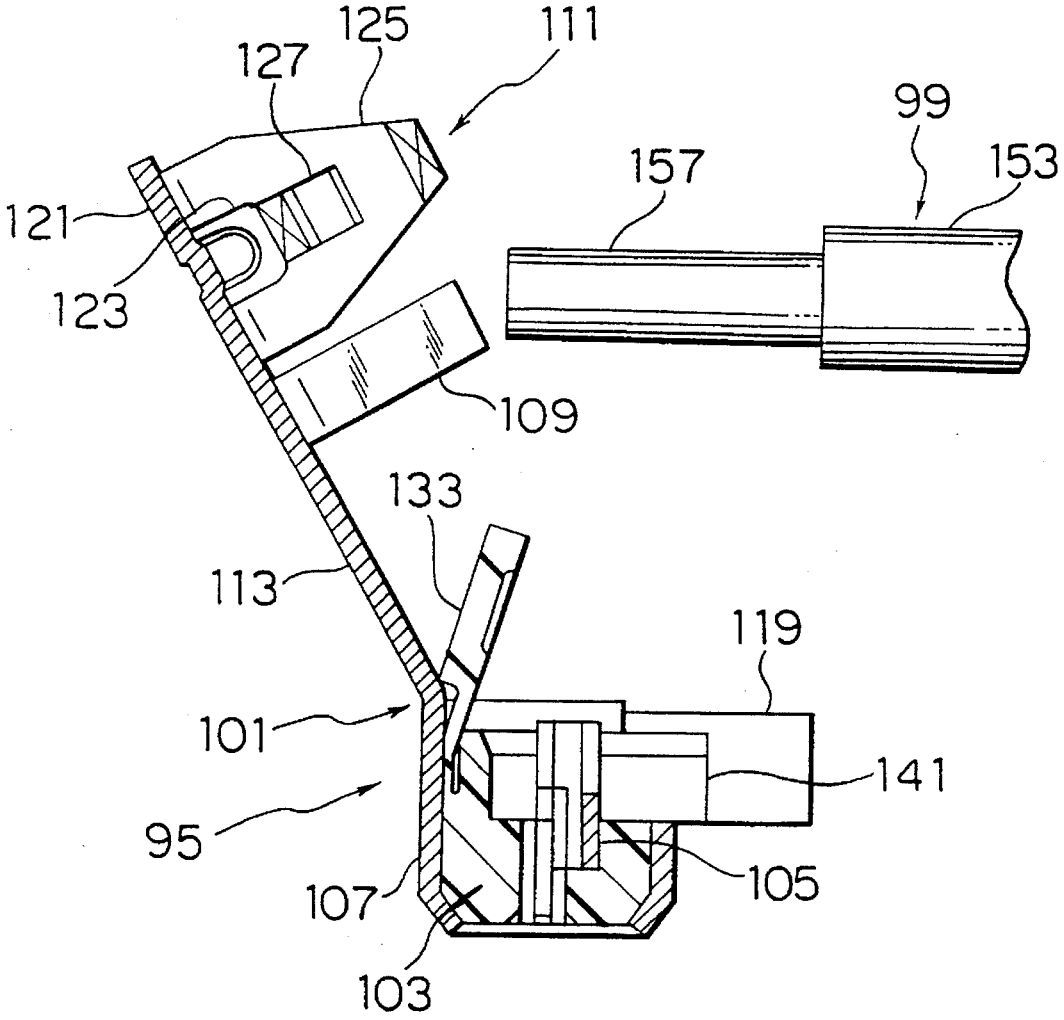
FIG. 21 is a view showing an open state of the coaxial connector plug of FIGS. 15A–15C for connection with the coaxial cable.
Figure 22A:
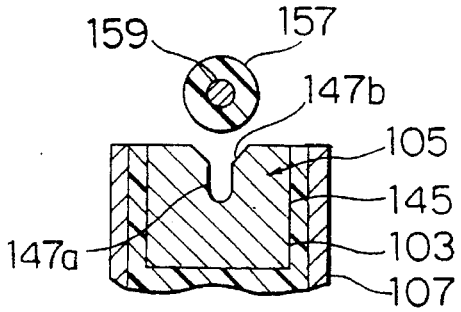
FIGS. 22A–22D are views for illustrating press-contact processes between an inner conductor of the coaxial cable and the inner contact of the coaxial connector plug of FIG. 21, FIG. 22A showing a state before contact, FIG. 22B showing a state of the cable positioned, FIG. 22C showing a state of being press-contacted by a press-contact tool, and FIG. 22D showing a side view of the press-contact process of FIG. 22C.
Figure 22B:
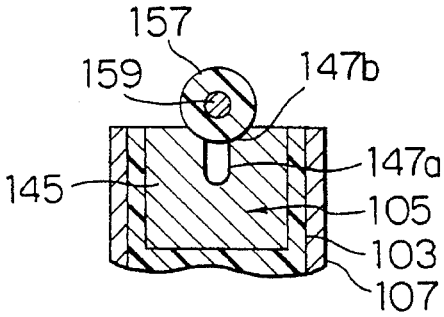
Figure 22C:
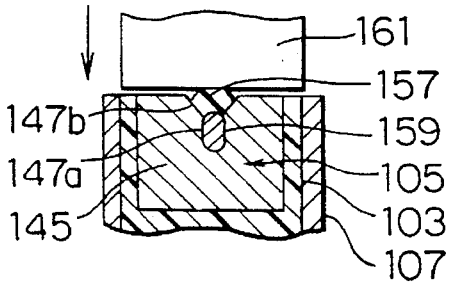
Figure 22D:
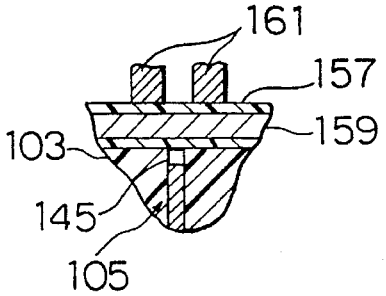
Figure 23:
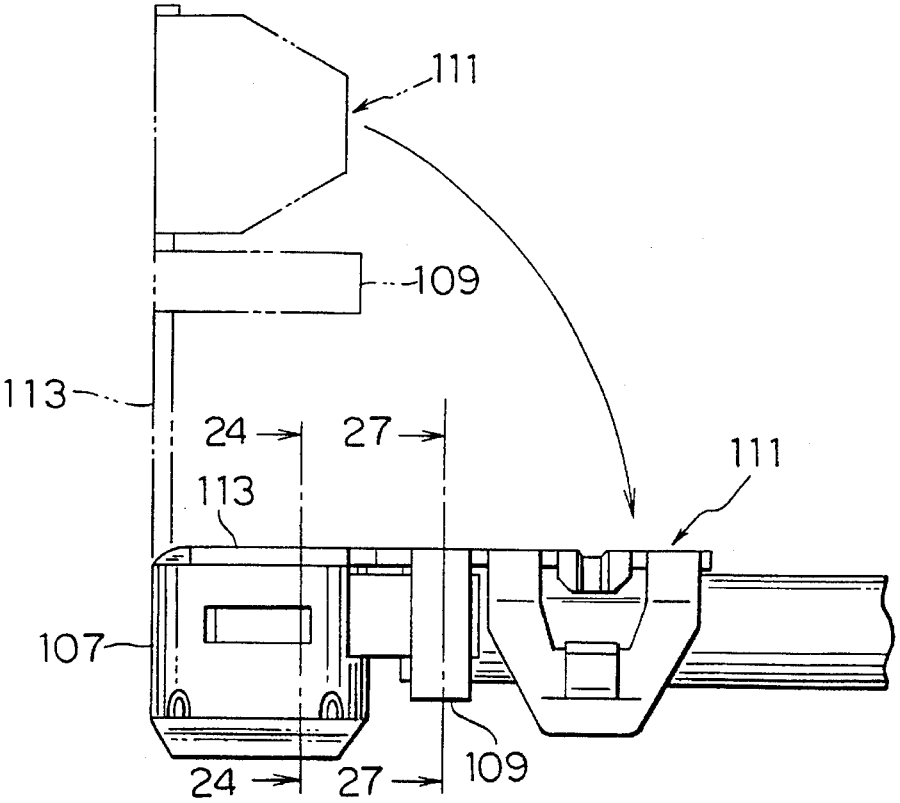
FIG. 23 is a view for illustrating a connection process between the plug outer contact of the coaxial connector plug of FIGS. 15A–15C and the coaxial cable.
Figure 24:
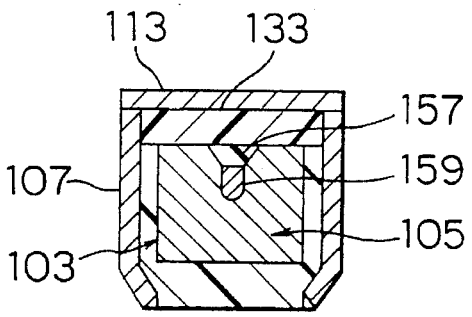
FIG. 24 is a sectional view taken along a line 24—24 in FIG. 23.
Figure 25A:
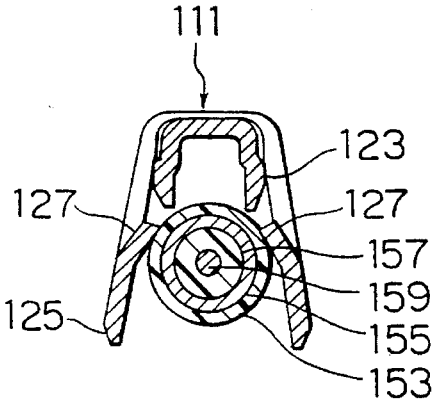
FIGS. 25A–25D are views for illustrating press-bonding processes between a press-bonding portion of an outer contact of the coaxial connector plug and the coaxial cable, FIG. 25A showing a positioning of the cable, FIG. 25B showing a progressed positioning process of the cable, FIG. 25C showing a state in the middle of the press-bonding by a press-bonding tool, and FIG. 25D showing a state after completion of the press-bonding by the press-bonding tool.
Figure 25B:
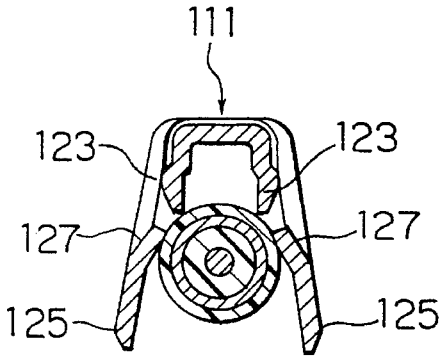
Figure 25C:
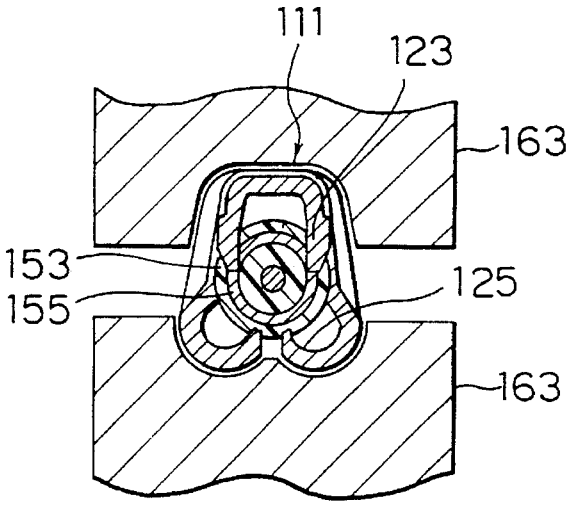
Figure 25D:
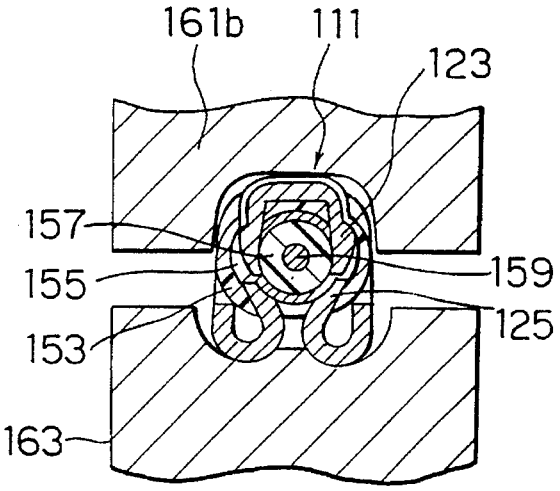

As shown in FIG. 21, the insulator 103 is received within the outer shell portion 107 of the outer contact 101. The insulator 103 has the inner contact receiving portion 135 (see FIG. 18) in which the inner contact 105 is received. Thereafter, the coaxial cable 99 with one end thereof processed is disposed on the plug 95. The coaxial cable 99 is positioned so that the inner insulator 157 and the inner conductor 159 are inserted in the guide groove 139 of the insulator 103. Then, as illustrated in FIGS. 22A, 22B, 22C, and 22D, the inner insulator 157 and the inner conductor 159 of the coaxial cable 99 (see FIG. 20) are disposed on the press-contact blades 147*b* of the inner contact 105 of the plug 95. With this condition, a press-contact tool 161 is operated. By this operation, the inner insulator 157 of the coaxial cable 99 is cut by the press-contact blades 147*b* of the inner contact 105. At the same time, the inner conductor 159 of the coaxial cable 99 is forced into the U-shaped groove 147*a* of the inner contact 105 to be electrically connected. Thereafter, the insulating cover 133 (see FIG. 21) of the insulator 103 is bent at the hinge 131 so that the opening portion 143 (see FIG. 18) is closed. Simultaneously, the inner contact 105 is insulated from the outer contact 101 (see FIGS. 15 and 16). As illustrated in FIGS. 23 and 24, the cover portion 113 of the outer contact 101 (see FIGS. 15 and 16) is bent perpendicularly at the connecting portion with the outer shell portion 107. Then, the press-bonding portion 111 is press-bonded to the coaxial cable 99. Additionally, the band portion 109 is wound around the outer periphery of the coaxial cable 99 (see FIG. 15C).

With reference to FIGS. 25A, 25B, 25C, and 25D, the coaxial cable 99 is guided by the guide portion 127 to be centered in the press-bonding portion 111. Thereafter, press-bonding is carried out by the press-bonding tool 163. The pair of first press-bonding pieces 123 penetrate the sheath 153 and proceed further so as to bite into a boundary between the outer conductor 155 and the inner insulator 157. On the other hand, the tip portion of each of the second press-bonding pieces 125 is crimped by the press-bonding tool 163. Accordingly, the tip portion penetrates the sheath 153 and proceeds so as to bite into between the sheath 153 and the outer conductor 155.

Figure 26:
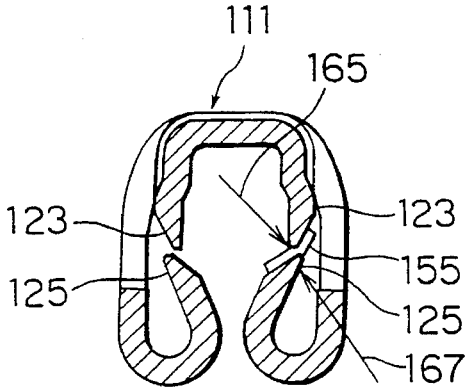
FIG. 26 is a view showing elasticity of the cable press-bonding portion in a state after the completion of the press-bonding illustrated in FIGS. 25A to 25D.

Referring to FIG. 26, the first and the second press-bonding pieces 123 and 125 have elasticity in a respective direction of arrows 165 and 167. With this elasticity, the outer conductor 155 of the coaxial cable 99 is put between the press-bonding pieces to ensure reliable electrical contact.

Figure 27:
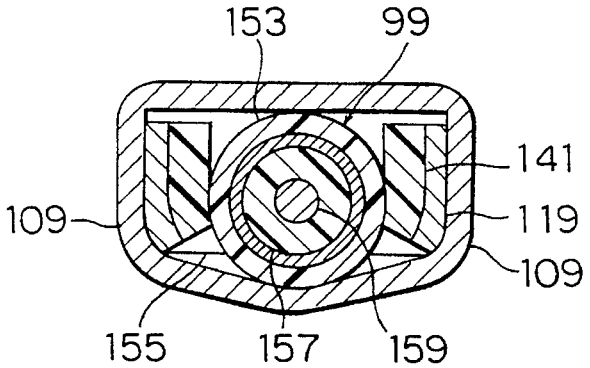
FIG. 27 is a sectional view taken along a line 27—27 in FIG. 23.

As shown in FIG. 27, the band portion 109 is wound around the periphery of the coaxial cable 99 and the cable guide portions 141 and 119 so as to prevent the outer cover portion 113 (see FIG. 21) from lifting from the coaxial cable 99.

Figure 28:
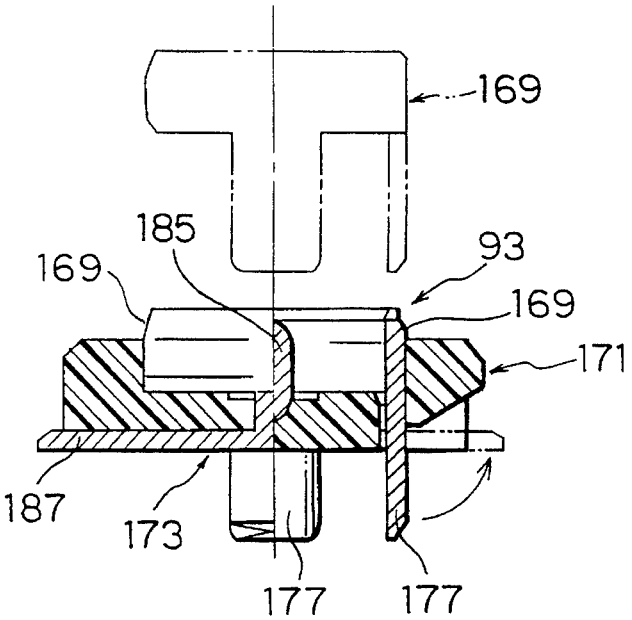
FIG. 28 is a sectional view showing an assembly of a coaxial connector receptacle according to the embodiment of this invention.
Figure 29A:
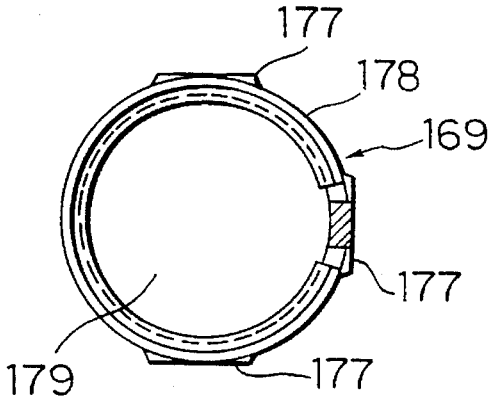
FIG. 29A is a plan view showing a receptacle outer contact of the coaxial connector receptacle of FIG. 28.
Figure 29B:
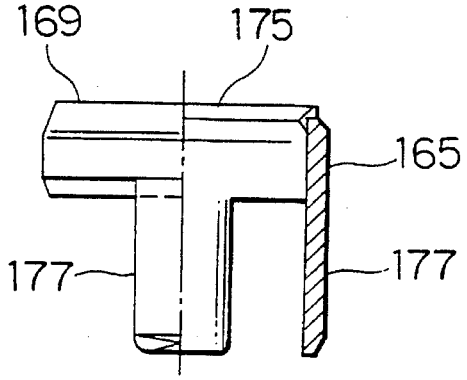
FIG. 29B is a half-sectional front view showing the receptacle outer contact of FIG. 29A.

With reference to FIGS. 28, 29A, 29B, 30A, and 30B, description is made as regards the receptacle 93. As shown in FIG. 28, the receptacle 93 comprises a receptacle outer contact 169, a receptacle insulator 171, and a receptacle inner contact 173. As illustrated in FIGS. 29A and 29B, the receptacle outer contact 169 has a cylindrical third contact portion 175 to which the plug outer contact 101 of the plug 95 (see FIG. 21) is fitted and electrically connected. A plurality of (for example, three) leg-like terminal portions 177 extend downward from the third contact portion 175. The contact portion 175 has an opening 179 in which the plug outer contact 101 of the plug 95 is inserted.

Figure 30A:
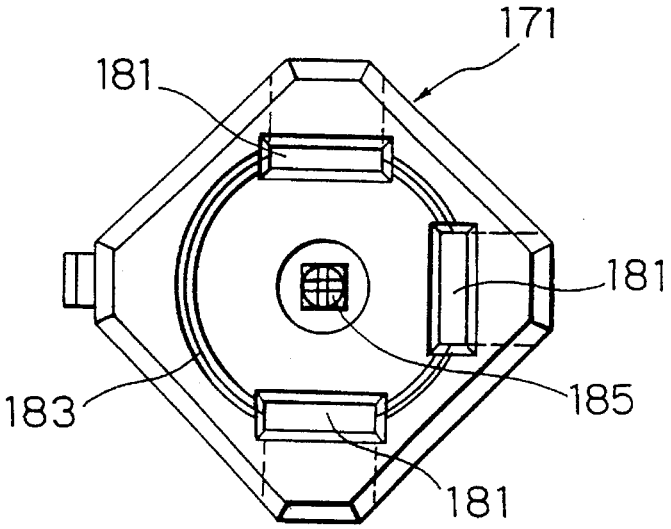
FIG. 30A is a plan view showing a receptacle insulator of the coaxial connector receptacle of FIG. 28.
Figure 30B:
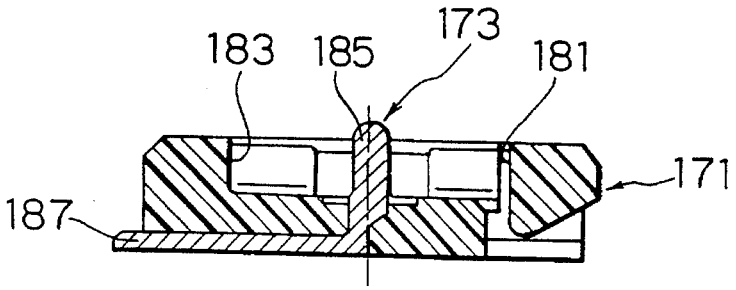
FIG. 30B is a front sectional view showing the receptacle insulator of FIG. 30A.

As shown in FIGS. 30A and 30B, the receptacle insulator 171 of the receptacle 93 has a plurality of insertion holes 181 being used as a receiving portion in which the terminal portions 177 (see FIG. 29B) of the receptacle outer contact 169 are inserted and received. The receptacle insulator 171 has also a depressed guide portion 183 for receiving the third contact portion 175 of the receptacle outer contact 169. In the central part of the receptacle insulator 171, the receptacle inner contact 173 press-formed is molded. The receptacle inner contact 173 comprises a fourth contact portion 185 electrically brought into contact with the contact portion 151 of the plug inner contact 105 of the plug 95 (see FIG. 21) and a terminal portion 187 electrically connected to the printed circuit board 97 illustrated in FIG. 13.

Returning to FIG. 28, the receptacle outer contact 169 is perpendicularly bent after the terminal portions 177 are inserted in the insertion holes 181 of the receptacle insulator 171. The bent terminal portions 177 are electrically connected to the printed circuit board 97 illustrated in FIG. 13.

According to the above-mentioned preferred embodiment, the outer shell portion 107 of the plug outer contact 101 as the first contact portion which is brought into contact with the outer conductor of the coaxial cable of the plug 95, the press-bonding portion 111 as the second contact portion having the press-bonding pieces arranged to surround the coaxial cable 99, and the band portion 109 are integrally coupled through the cover portion 113 as the coupling portion. Thus, it is not necessary to use the conventional clamp ring as a separate part. This results in a reduction of the number of parts and of cost of parts. This also makes it possible to reduce production cost. In addition, it is possible to lower a height of the coaxial connector after the coaxial cable 99 is connected thereto since the clamp ring becomes unnecessary.

Therefore, miniaturization of the coaxial connector can be achieved.

Additionally, according to this invention, the inner conductor 159 of the coaxial cable 99 is press-contacted with the plug inner contact 163 of the plug 95 and the plug outer contact 101 of the plug 95 is press-bonded to the outer conductor 155 of the coaxial cable 99 by the press-bonding portion 111 having the first and the second press-bonding pieces (123, 125). Accordingly, electrical connection between the plug 95 and the coaxial cable 99 can be carried out extremely easily by the use of the press-bonding tool and the press-contact tool. As a result, connection operation with the coaxial cable 99 becomes remarkably simple and production step of assembling can be reduced. Moreover, it is possible to further reduce production step of processing and to simplify processing treatment of the end portion of the coaxial cable 99 because press-bonding process of the press-bonding portion 111 is carried out when closing the cover portion 113. Additionally, in the receptacle, the inner contact 173 is molded in the insulator 171, so that press-fitting of the inner contact is not necessary. It is therefore possible to reduce the receptacle assembling time and to miniaturize the receptacle.

Furthermore, the plug inner contact 163 of the coaxial connector plug 95 has the press-contact piece press-contacted with the inner conductor 159 of the coaxial cable 99. In this case, conventional soldering operation is no longer needed. It is possible to prevent the peripheral parts from such as damages due to heat and to carry out connection operation extremely easily without requiring skill.

What is claimed is:

1. A coaxial connector plug (95) in combination with a coaxial cable comprising a plug outer contact (101) having a first contact portion (107) to be brought into contact with a receptacle outer contact (169) of a coaxial connector receptacle (93) and a second contact portion (111) to be brought into contact with an outer conductor (155) of a coaxial cable (99), wherein said first contact portion and said second contact portion are integrally coupled by way of a coupling portion (113), said second contact portion having a plurality of press-bonding pieces (123, 125) for penetrating a sheath (153) of said coaxial cable to come into contact with said outer conductor of said coaxial cable, said press-bonding pieces being arranged so as to surround said coaxial cable and comprising a first press-bonding piece (123) for penetrating said coaxial cable inside said outer conductor and a second press-bonding piece (125) for penetrating said coaxial cable outside said outer conductor, said outer conductor being partially held between said first press-bonding piece and said second press-bonding piece.

2. A coaxial connector plug as claimed in claim 1, further comprising a plug inner contact (105) having a press-contact portion (147) to be press-contacted with an inner conductor of said coaxial cable.

3. A coaxial connector plug as claimed in claim 2, wherein said coupling portion and said press-bonding pieces are separated by a predetermined distance.

4. A coaxial connector plug as claimed in claim 3, wherein said plug outer contact comprises a plug insulator (103) for receiving one end portion of said coaxial cable and an insulator receiving portion (107) located at said first contact portion to hold said plug insulator.

5. A coaxial connector plug as claimed in claim 4, wherein said press-contact portion comprises a slitted groove (147*a*) and a press-contact blade (147*b*) formed at both sides of an opening of said slitted groove so as to penetrate an insulator (157) formed at a periphery of said inner conductor of said coaxial cable to be brought into contact with said inner conductor.

6. A coaxial connector plug as claimed in claim 5, wherein said plug inner contact (105) is received within said insulator.

7. A coaxial connector plug as claimed in claim 7, wherein said coaxial cable has a connection end portion having a shape such that said outer conductor is covered with said sheath and said inner conductor covered with said insulator projects from said outer conductor in an axial direction.

8. A coaxial connector in combination with a coaxial cable, comprising a coaxial connector receptacle (93) having a receptacle outer contact (169), and a coaxial connector plug (95) having a plug outer contact (101) with a first contact portion (107) to be brought into contact with said receptacle outer contact and a second contact portion (111) to be brought into contact with an outer conductor (155) of a coaxial cable (99), wherein said first contact portion and said second contact portion of said coaxial connector plug are integrally coupled by way of coupling portion (113), said second contact portion having a plurality of press-bonding pieces (123, 127) for penetrating a sheath (153) of said coaxial cable to come into contact with said outer conductor of said coaxial cable, said press-bonding pieces being arranged so as to surround said coaxial cable and comprising a first press-bonding piece (123) for penetrating said coaxial cable inside said outer conductor (153) and a second press-bonding piece (125) for penetrating said coaxial cable outside said outer conductor (155), said outer conductor being partially held between said first press-bonding piece and said second press-bonding piece.

9. A coaxial connector as claimed in claim 8, wherein said coaxial connector plug comprises a plug inner contact (105) having a press-contact portion (145) to be press-contacted with an inner conductor (159) of said coaxial cable.

10. A coaxial connector as claimed in claim 9, wherein said coupling portion and said press-bonding portion are positioned so as to separate each other by a predetermined distance.

11. A coaxial connector as claimed in claim 10, wherein said plug outer contact comprises a plug insulator (103) for receiving one end portion of said coaxial cable and an insulator receiving portion (107) which is located at said first contact portion so as to hold said plug insulator.

12. A coaxial connector as claimed in claim 11, wherein said press-contact portion (145) comprises a slitted groove (147*a*) and a press-contact blade (147*b*) formed at both sides of an opening of said slitted groove so that said press-contact portion penetrates an insulator (157) formed at the periphery of said inner conductor of said coaxial cable to be brought into contact with said inner conductor.

13. A coaxial connector as claimed in claim 12, wherein said plug inner contact is received in said plug insulator.

14. A coaxial connector as claimed in claim 13, wherein said coaxial connector plug is rotatable with respect to said coaxial connector receptacle, said coaxial cable extending in a direction intersecting a central axis of said coaxial connector plug.

* * * * *